US008257161B2

(12) United States Patent
Louie et al.

(10) Patent No.: US 8,257,161 B2
(45) Date of Patent: Sep. 4, 2012

(54) GAMING SYSTEM HAVING COLLECTIBLE AND REDEEMABLE SPECIAL SYMBOLS

(75) Inventors: Daniel P. Louie, Chicago, IL (US); Benjamin T. Gomez, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 947 days.

(21) Appl. No.: 12/291,609

(22) Filed: Nov. 12, 2008

(65) Prior Publication Data

US 2009/0075722 A1 Mar. 19, 2009

Related U.S. Application Data

(63) Continuation-in-part of application No. PCT/US2007/025618, filed on Dec. 14, 2007.

(60) Provisional application No. 60/880,686, filed on Jan. 16, 2007.

(51) Int. Cl.
*A63F 9/24* (2006.01)

(52) U.S. Cl. ..... 463/20; 463/16

(58) Field of Classification Search ..... 463/20–25
See application file for complete search history.

(56) References Cited

U.S. PATENT DOCUMENTS

| | | | | |
|---|---|---|---|---|
| 5,947,820 | A * | 9/1999 | Morro et al. | 463/9 |
| 5,997,401 | A | 12/1999 | Crawford | |
| 6,270,412 | B1 * | 8/2001 | Crawford et al. | 463/20 |
| 6,439,993 | B1 | 8/2002 | O'Halloran | |
| 6,494,454 | B2 | 12/2002 | Adams | |
| 6,517,432 | B1 | 2/2003 | Jaffe | |
| 6,551,187 | B1 | 4/2003 | Jaffe | |
| 6,616,142 | B2 | 9/2003 | Adams | |
| 6,780,109 | B2 | 8/2004 | Kaminkow | |
| 6,805,349 | B2 | 10/2004 | Baerlocher et al. | |
| 6,805,632 | B2 | 10/2004 | Suda | |
| 6,866,583 | B2 | 3/2005 | Glavich et al. | |
| 6,905,406 | B2 | 6/2005 | Kaminkow et al. | |
| 6,921,335 | B2 | 7/2005 | Rodgers et al. | |
| 6,935,947 | B1 * | 8/2005 | Singer et al. | 463/16 |
| 6,979,263 | B2 * | 12/2005 | Baerlocher et al. | 463/20 |
| 2002/0047238 | A1 | 4/2002 | Ainsworth et al. | |
| 2002/0052233 | A1 | 5/2002 | Gauselmann | |

(Continued)

FOREIGN PATENT DOCUMENTS

WO WO 2004/095383 11/2004

OTHER PUBLICATIONS

International Search Report corresponding to PCT/US2007/025618, United States Patent Office, dated Jul. 4, 2008; 4 pages.

(Continued)

*Primary Examiner* — Masud Ahmed
(74) *Attorney, Agent, or Firm* — Nixon Peabody LLP

(57) ABSTRACT

A gaming system comprises a wager input device and a display for displaying a first matrix of symbols representing a randomly selected outcome of the wagering game, the symbols selected from a plurality of symbols including at least one special symbol. The system further includes a controller operative to (i) collect occurrences of the at least one special symbol in the first matrix, (ii) vary the symbols to create a final matrix of symbols, (iii) redeem the collected special symbols by placing the collected special symbols into the final matrix, and (iv) provide an award if the final matrix of symbols indicates a winning combination.

30 Claims, 16 Drawing Sheets

U.S. PATENT DOCUMENTS

| | | | | |
|---|---|---|---|---|
| 2002/0082075 | A1 | 6/2002 | Meyer | |
| 2003/0013517 | A1 | 1/2003 | Bennett et al. | |
| 2003/0054874 | A1 | 3/2003 | Kaminkow | |
| 2003/0057645 | A1 | 3/2003 | Baerlocher et al. | |
| 2003/0060267 | A1 | 3/2003 | Glavich et al. | |
| 2003/0064779 | A1 | 4/2003 | Suda | |
| 2003/0064802 | A1 | 4/2003 | Rodgers et al. | |
| 2003/0069062 | A1 | 4/2003 | Shimizu | |
| 2003/0203752 | A1 | 10/2003 | Kaminkow et al. | |
| 2003/0203753 | A1 | 10/2003 | Muir et al. | |
| 2003/0207709 | A1 | 11/2003 | Paotrakul | |
| 2004/0023714 | A1* | 2/2004 | Asdale | 463/22 |
| 2004/0038730 | A1 | 2/2004 | Suda | |
| 2004/0048646 | A1 | 3/2004 | Visocnik | |
| 2004/0048652 | A1 | 3/2004 | Ching et al. | |
| 2004/0053676 | A1 | 3/2004 | Rodgers | |
| 2004/0072612 | A1 | 4/2004 | Rodgers et al. | |
| 2004/0137982 | A1 | 7/2004 | Cuddy et al. | |
| 2005/0020344 | A1 | 1/2005 | Kaminkow | |
| 2005/0049035 | A1 | 3/2005 | Baerlocher et al. | |
| 2005/0054412 | A1 | 3/2005 | Gauselmann | |
| 2005/0064924 | A1 | 3/2005 | Glavich et al. | |
| 2005/0101369 | A1 | 5/2005 | Meyer | |
| 2005/0101380 | A1 | 5/2005 | Glavich et al. | |
| 2005/0148384 | A1 | 7/2005 | Marks et al. | |
| 2005/0164775 | A1 | 7/2005 | Rodgers et al. | |
| 2006/0063582 | A1* | 3/2006 | Baerlocher et al. | 463/16 |
| 2006/0068884 | A1* | 3/2006 | Baerlocher et al. | 463/20 |
| 2006/0068893 | A1* | 3/2006 | Jaffe et al. | 463/20 |
| 2006/0172796 | A1 | 8/2006 | Vancura | |
| 2006/0287035 | A1* | 12/2006 | Walker et al. | 463/13 |
| 2007/0042824 | A1* | 2/2007 | Randall | 463/16 |
| 2008/0026822 | A1* | 1/2008 | Walker et al. | 463/25 |

OTHER PUBLICATIONS

International Written Opinion corresponding to PCT/US2007/025618, United States Patent Office, dated Jul. 4, 2008; 5 pages.

International Preliminary Report on Patentability corresponding to PCT/US2007/025618, United States Patent Office, dated Jul. 21, 2009; 6 pages.

* cited by examiner

GAMING SYSTEM HAVING COLLECTIBLE AND REDEEMABLE SPECIAL SYMBOLS

This application is a Continuation-In-Part of PCT Application, PCT/US2007/025618 filed on Dec. 14, 2007, which claims priority to Provisional Application, 60/880,686 filed on Jan. 16, 2007.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming machines, and methods for playing wagering games, and more particularly, to a gaming system having collectible and redeemable special symbols.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming systems with new types of bonus games to satisfy the demands of players and operators.

Traditionally, gaming machines provide players with various awards and prizes in both primary games and a variety of bonus games. Often, gaming machines use special symbols, such as wild symbols and multipliers, to increase awards to players and create excitement and enjoyment during play of the wagering game. One problem that arises is special symbols in the wagering game are often "lost" or unused when they do not form part of a winning combination. This creates disappointment for the player who visually perceives the special symbol but does not receive its benefits. Another problem that exists is that special symbols are limited in number and on any one play of the wagering game, are limited in the size of award which can be generated. The present invention is directed to solving these and other problems.

SUMMARY OF THE INVENTION

According to one aspect of the present invention, a gaming system comprises a wager input device and a display for displaying a first matrix of symbols representing a randomly selected outcome of the wagering game, the symbols selected from a plurality of symbols including at least one special symbol. The system further includes a controller operative to (i) collect occurrences of the at least one special symbol in the first matrix, (ii) vary the symbols to create a final matrix of symbols, (iii) redeem the collected special symbols by placing the collected special symbols into the final matrix, and (iv) provide an award if the final matrix of symbols indicates a winning combination.

According to another aspect of the invention, a method of conducting a wagering game on a gaming system comprises receiving a wager and sequentially displaying a plurality of matrices of symbols representing randomly selected outcomes of the wagering game, the symbols selected from a plurality of symbols including at least one special symbol. The method further comprises collecting occurrences of the at least one special symbol in the sequence of matrices. The method further comprises displaying a final matrix of symbols and redeeming at least a portion of the collected special symbols by placing the portion of collected special symbols into the final matrix. The method further comprises providing an award if the final matrix of symbols indicates a winning combination.

According to yet another aspect of the invention, a method of conducting a wagering game on a gaming system comprises receiving a wager, triggering a bonus game, and awarding a number of free plays of the bonus game. The method further comprises, for each free play of the bonus game, (i) displaying a matrix of symbols representing a randomly selected outcome of the bonus game, the symbols selected from a plurality of symbols including at least one special symbol, and (ii) collecting any occurrences of the at least one special symbol in the matrix. The method further comprises, after the free plays are complete, displaying a subsequent matrix of symbols, redeeming the collected special symbols by replacing a first group of symbols in the subsequent matrix with the collected special symbols, and providing an award if the subsequent matrix of symbols indicates a winning combination.

According to yet another aspect of the invention, a gaming system comprises a wager input device and a first display for displaying a first matrix of symbols representing a randomly selected outcome of the wagering game. The symbols are selected from a plurality of symbols including at least one special symbol. The system further includes a controller operative to (i) copy each occurrence of the at least one special symbol in the first matrix to a corresponding collection position in a second matrix, (ii) vary the symbols in the first matrix to create a final matrix of symbols, (iii) redeem the collected special symbols by re-copying each such collected special symbol from the second matrix to a corresponding redemption position in the final matrix, and (iv) provide an award if the final matrix of symbols indicates a winning combination.

According to yet another aspect of the invention, a computer readable storage medium is encoded with instructions for directing a gaming system to perform the above methods.

Additional aspects of the invention will be apparent to those of ordinary skill in the art in view of the detailed description of various embodiments, which is made with reference to the drawings, a brief description of which is provided below.

DETAILED DESCRIPTION

Figure 1A:
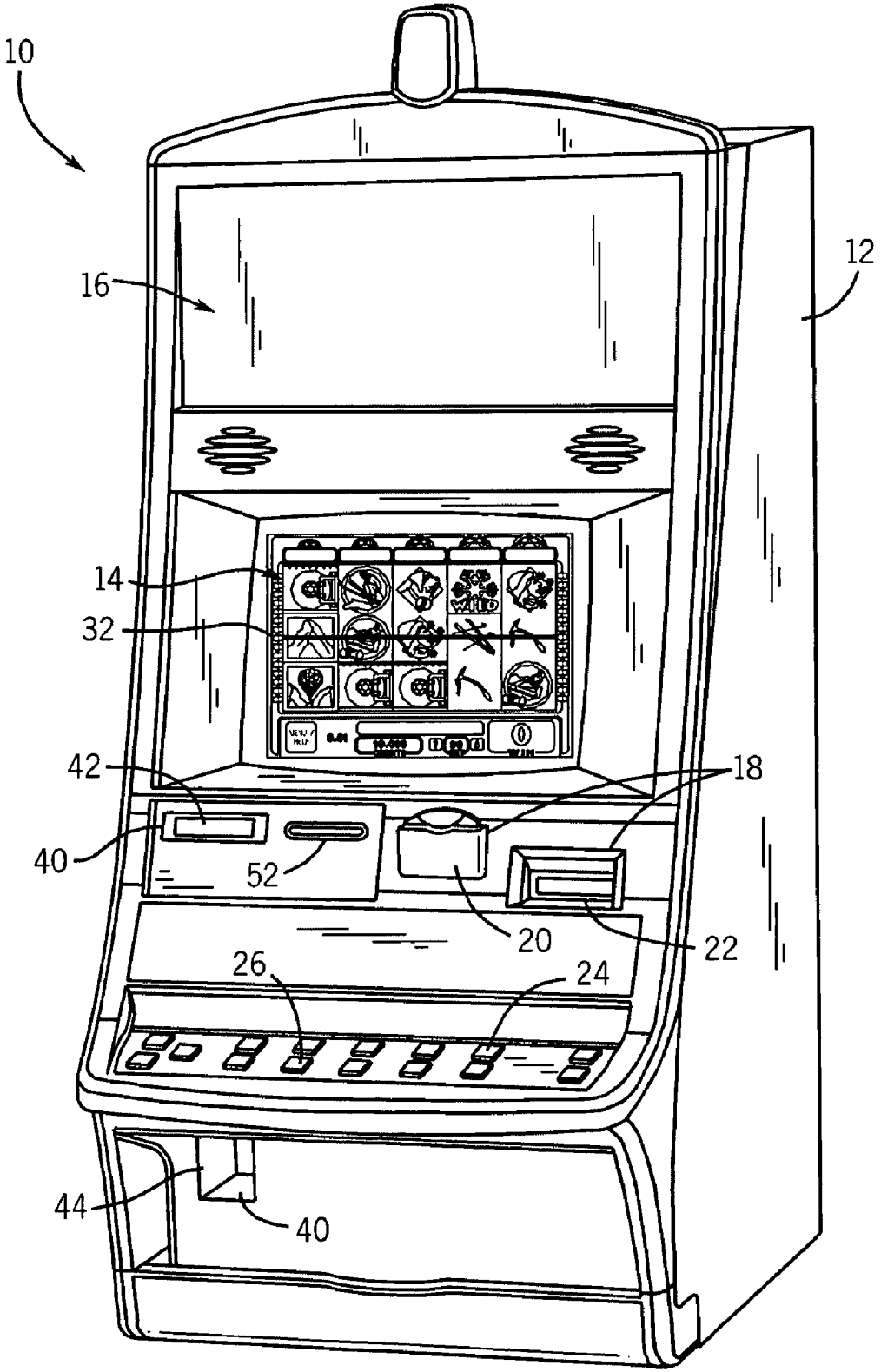
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one payline 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one payline 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
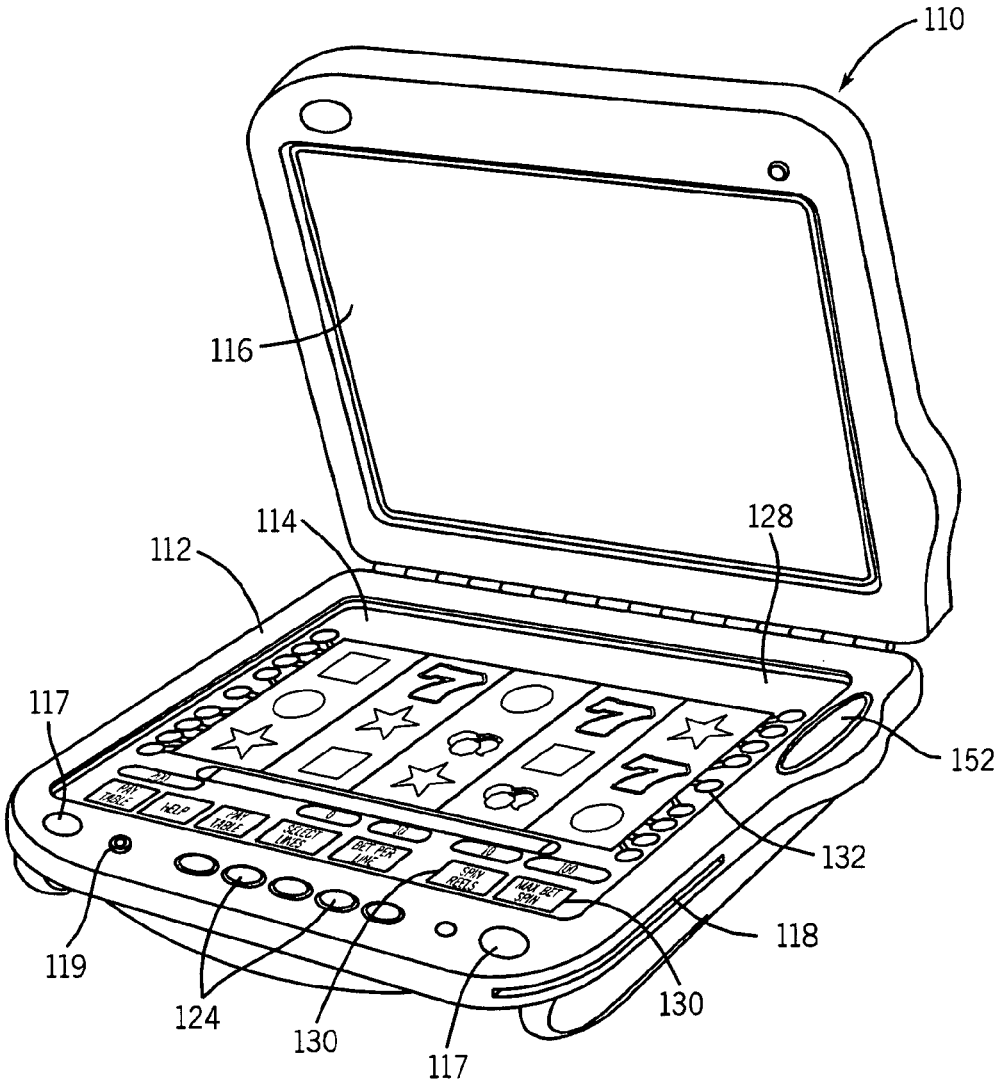
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen mounted to a primary display 114 and/or secondary display 116. In one aspect, the touch screen is matched to a display screen having one or more selectable touch keys 130 selectable by a user's touching of the associated area of the screen using a finger or a tool, such as a stylus pointer. A player enables a desired function either by touching the touch screen at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 110. In at least some aspects, the basic game may comprise a plurality of symbols arranged in an array, and includes at least one payline 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1*b*, comprises a biometric sensing device.

Figure 2:
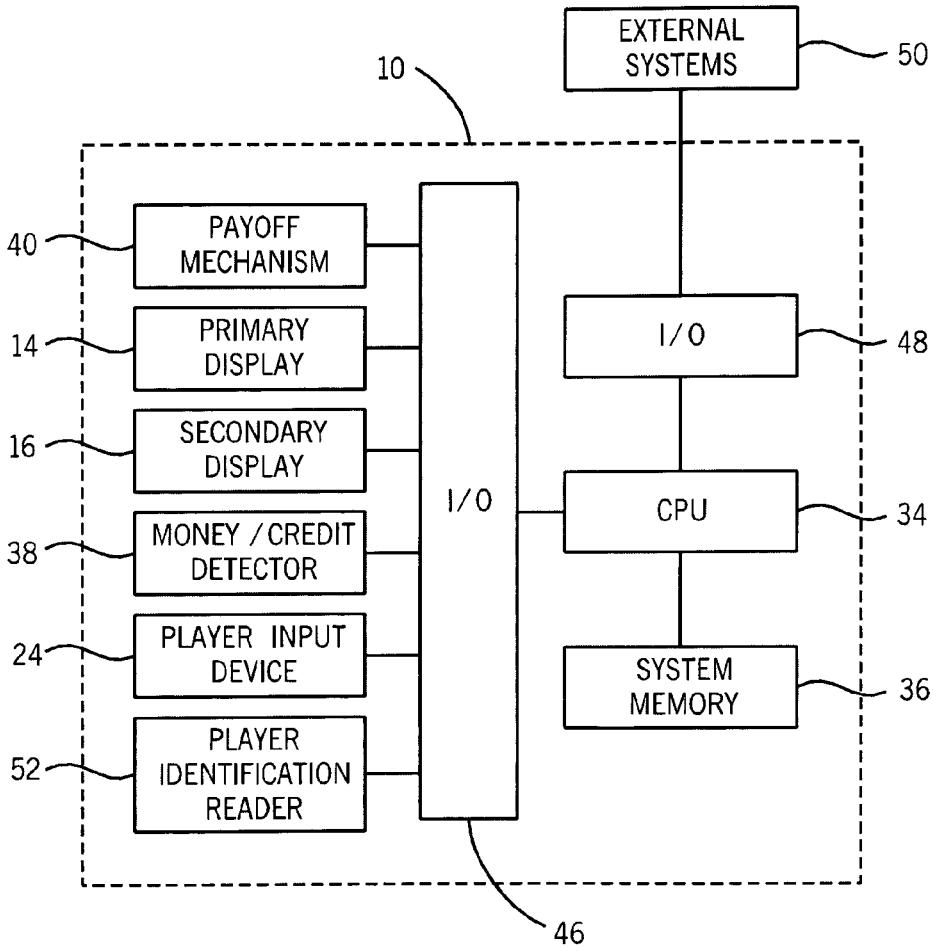
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1*a*, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10,110 may communicate with external systems 50 (in a wired or wireless manner) such that each machine operates as a "thin client," having relatively less functionality, a "thick client," having relatively more functionality, or through any range of functionality there between. As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "thicker client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10,110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
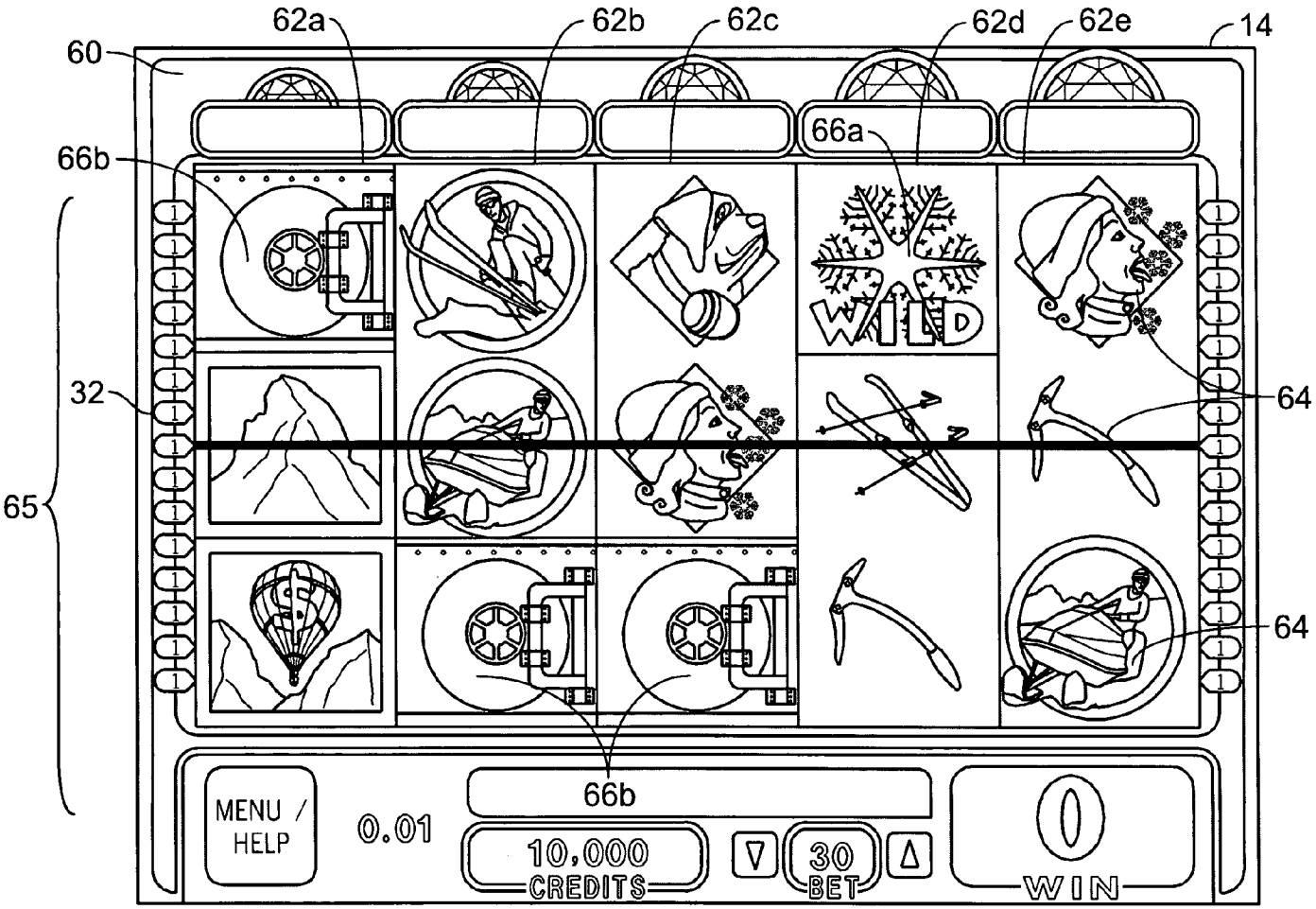
FIG. 3 is a front view of the primary display of a gaming system having collectible and redeemable special symbols.

Turning now to FIG. 3, the primary display 14 of a gaming device displaying a wagering game according to the present invention is shown. The wagering game may be displayed on the display 14 of a free standing gaming machine 10 as shown in FIGS. 1*a* and 3, or on the display 114 of a handheld gaming machine 110 as seen in FIG. 1*b*. The display 14 in FIG. 3 includes a wagering game 60, which in this embodiment is a slot game. The slot game 60 includes a plurality of reels 62*a,b,c,d,e* which may be either electro mechanical reels or simulations thereof on the primary display 14. The reels 62 include a plurality of symbols 64 displayed thereon which vary as the reels 62 are spun and stopped. The symbols 64 may include any variety of graphical symbols, elements, or representations, including symbols 64 which are associated with a theme of the gaming machine 10. The symbols 64 may also include a blank symbol, or empty space. As described herein the symbols 64 landing on the active paylines 32 (the paylines for which a wager has been received) are evaluated for winning combinations. If a winning combination of symbols 64 lands on an active payline 32, a primary award is awarded in accordance with a paytable of the gaming device. The symbols 64 on the reels 62 form a matrix 65 of symbols 64, which in this embodiment is a matrix 65 having three rows and five columns totaling fifteen symbols 64. In alternate embodiments, the matrix 65 may have greater or fewer symbols 64, and may take on a variety of different forms having greater or fewer rows and/or columns. The matrix 65 may even comprise other non rectangular forms or arrangements of symbols 64.

One or more of the symbols 64 on the reels 62 are special symbols 66, which are given additional functionality, purpose, weight, or evaluation as compared to standard symbols 64. As seen in FIG. 3, the snow flake symbol 66*a* is a special symbol 66 in that it acts as a "wild" symbol, as seen by the designation on the symbol 66*a*. In this embodiment, a wild symbol 66*a* functions to replace any other symbol 64 so as to improve the chances of obtaining a winning combination of symbols 64 on one or more active paylines 32. In other embodiments, the wild symbol 66*a* may have restrictions to its substitution abilities. For example, the wild symbol 66*a* may substitute for any standard symbol 64 to create winning combinations, but may not substitute for other special symbols 66.

In FIG. 3, the conclusion of a play of the gaming machine 10 is depicted. On the first three reels 62, three "vault" symbols 66*b* have landed on an active payline 32. In this embodiment, the vault symbols 66*b* are also special symbols 66, which serve as bonus triggering symbols. Thus, when three or more vault symbols 66*b* land on an active payline 32, a "Snowflake Bonus" is triggered. In this embodiment, the Snowflake Bonus is a free spin game where the player is awarded a number of free spins of the reels 62. During the Snowflake Bonus the snowflake wild symbols 66*a* are collected and redeemed as described in more detail herein.

Figure 4:
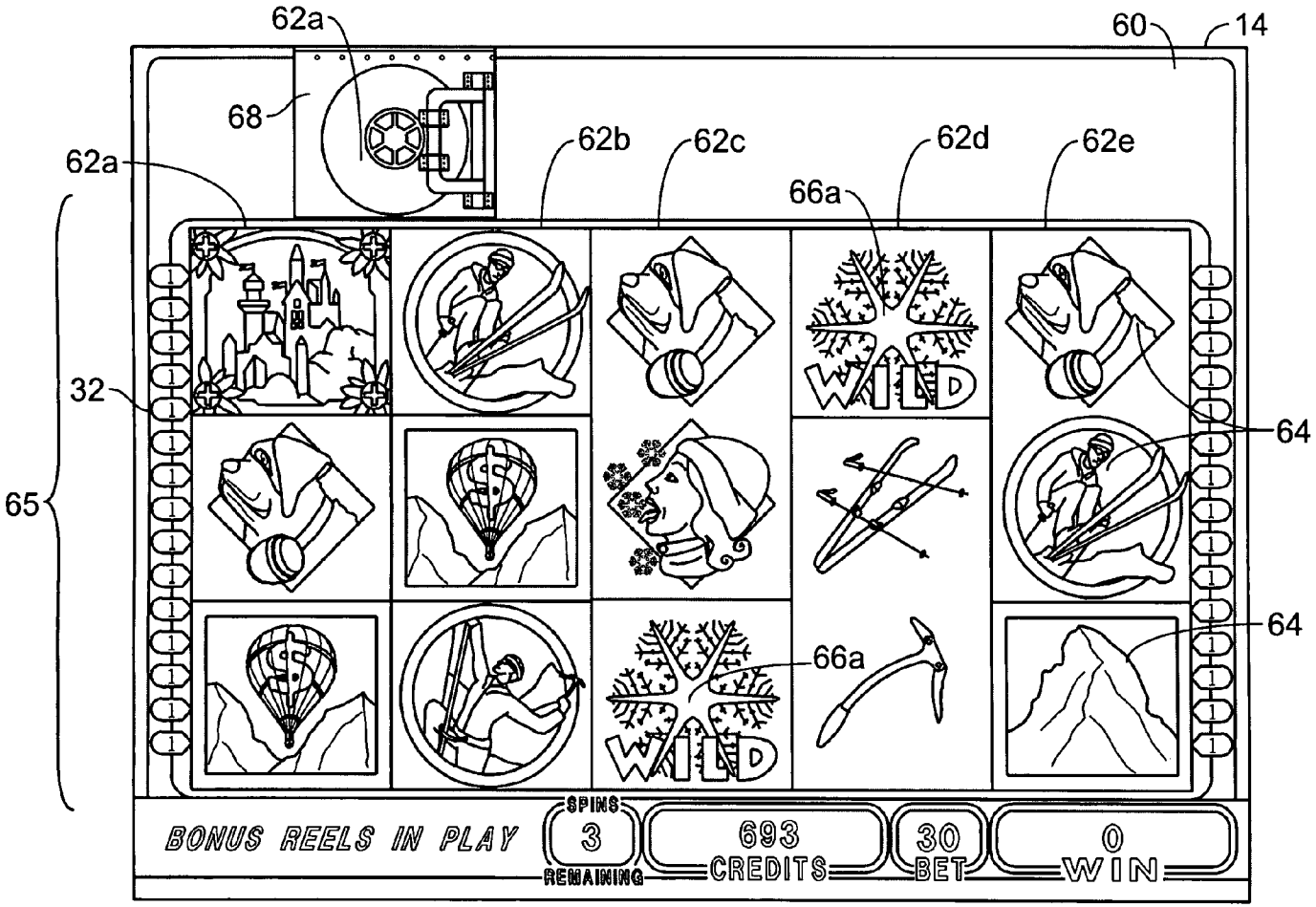
FIG. 4 is another view of the primary display, depicting a free spin game including collectible wild symbols.

Turning to FIG. 4, the commencement of the free spin bonus game is depicted. One of the vault symbols 68 which triggered the bonus game is depicted on the display 14 above the reels 62. The vault 68 serves to depict a collection point, or a "bank", where collected special symbols are stored and housed until redeemed. In this embodiment, the player is awarded five free spins in the bonus game. In alternative embodiments, the player may be awarded greater or fewer free spins, may make selections that determine how many spins he or she receives, or may be awarded a number of spins that are not predetermined (for example, may be allowed to spin until they lose, or allowed to make a selection to receive an additional spin, etc.) The reels 62 are spun and stopped to indicate a randomly selected outcome of the bonus game. In FIG. 3, two wild symbols 66*a* have landed on the reels 62 during a spin of the free spin bonus game. In this embodiment, because the wild symbols 66*a* are special symbols 66 which are collected and redeemed, collection of the wild symbols 66*a* occurs.

Figure 5:
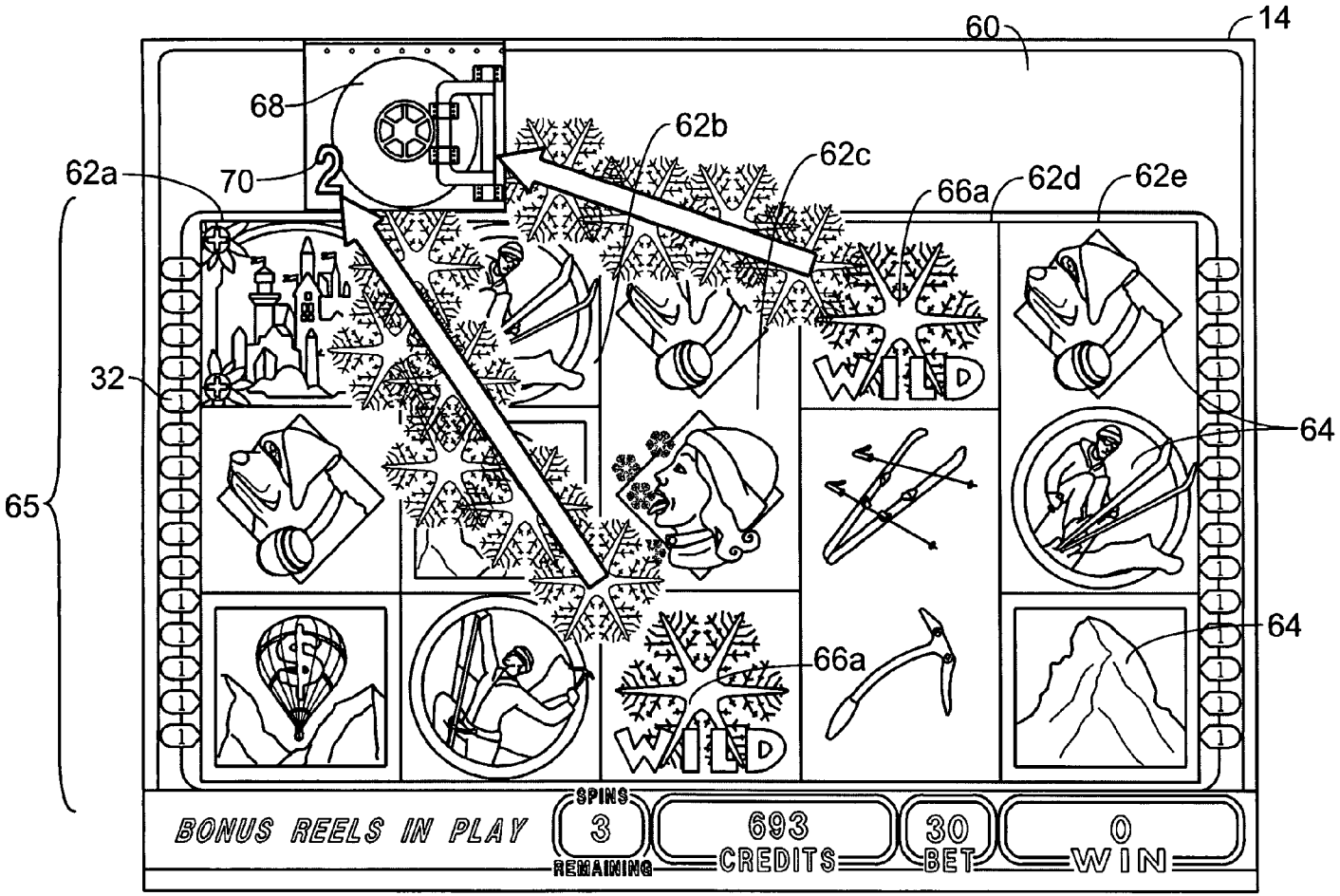
FIG. 5 is another view of the primary display, depicting the collection of two special symbols.

Turning to FIG. 5, the two wild symbols 66*a* which have landed on the reels 62 are collected for later redemption and use. In this embodiment the wild symbols 66*a* are lifted off of the reels 62 and transported to the vault 68 at the top of the display 14 where they are collected and stored. A collection meter 70 is displayed on the vault 68 showing how many wild symbols 66*a* have been collected so far in the free spin bonus game. In addition to the wild symbols 66*a* being collected, in some embodiments, the wild symbols 66*a* may be first used during the evaluation of winning combinations of symbols 62 on active paylines 32, prior to their collection in the vault 68. In other embodiments, after the wild symbols 66*a* are removed from the reels 62 and transported to the vault 68, they are replaced by standard symbols 62 underlying the wild symbols 66*a* on the reels, and an evaluation of winning combinations is undertaken.

Figure 6:
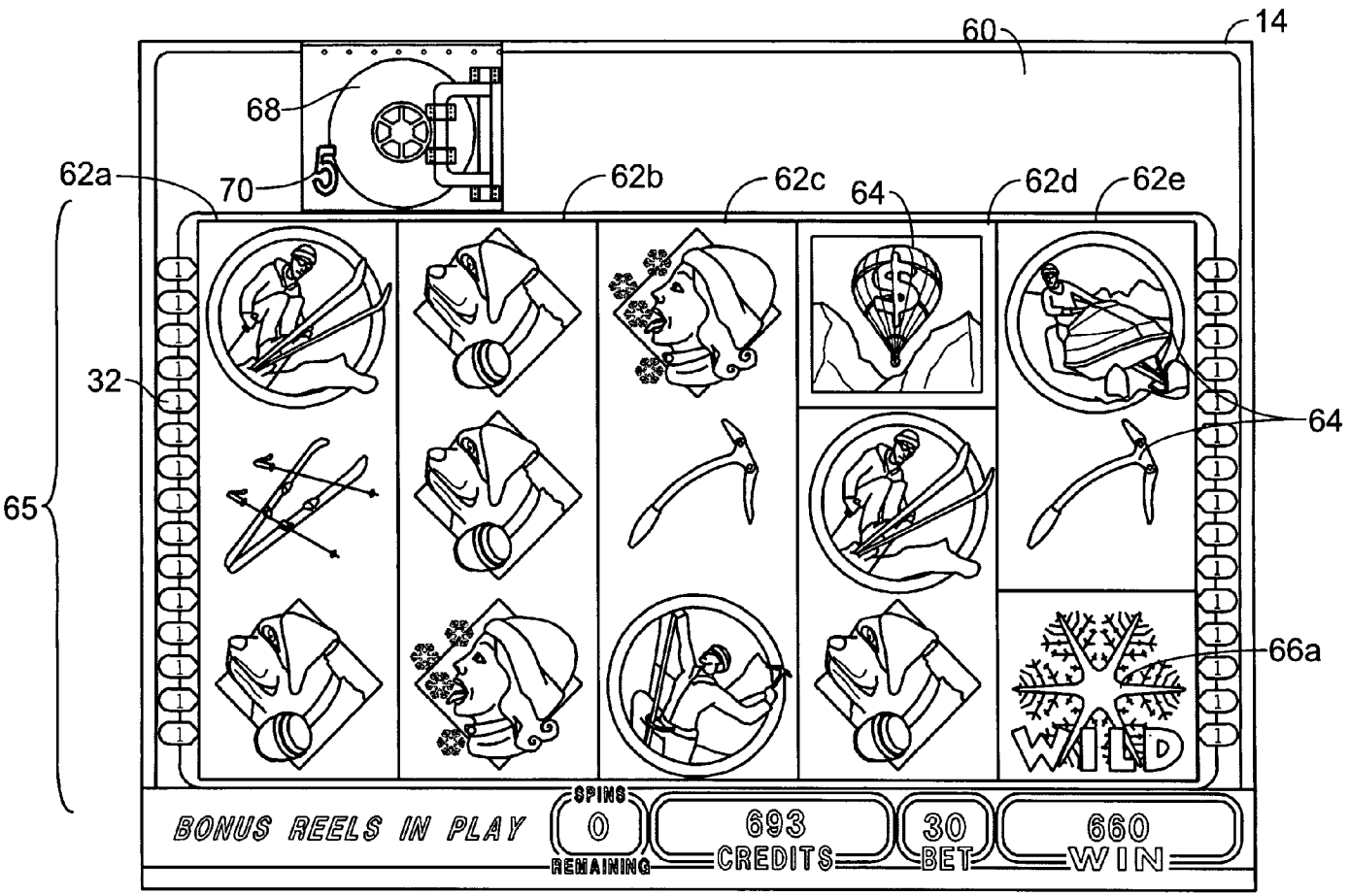
FIG. 6 is another view of the primary display, depicting the conclusion of the collection of special symbols.

In FIG. 6, the display 14 is shown following the conclusion of the five free spins awarded to the player in the free spin bonus game. The bottom of the display 14 indicates that the player has zero free spins remaining. At the top of the display 14, the vault 68 and the collection meter 70 indicate that the player was successful in collecting and accumulating five wild symbols 66*a* on the reels 62 during the free spin bonus game. At the conclusion of the free spins in which the wild symbols 66*a* are collected, the player is provided one additional spin, or "Super Spin", during which the collected special symbols 66*a* are redeemed. During the Super Spin, yet another randomly selected outcome of the wagering game 60 is depicted on the reels 62 as seen in FIG. 6. Any wild symbols 66*a* appearing on the reels 62 during the Super Spin are not collected because collection only occurs during the free spins, not the Super Spin. Instead, wild symbols 66*a* appearing during the Super Spin remain in their positions (such as the wild symbol 66*a* on the bottom position of the fifth reel) and are used in evaluating the winning combinations of the Super Spin.

Figure 7:
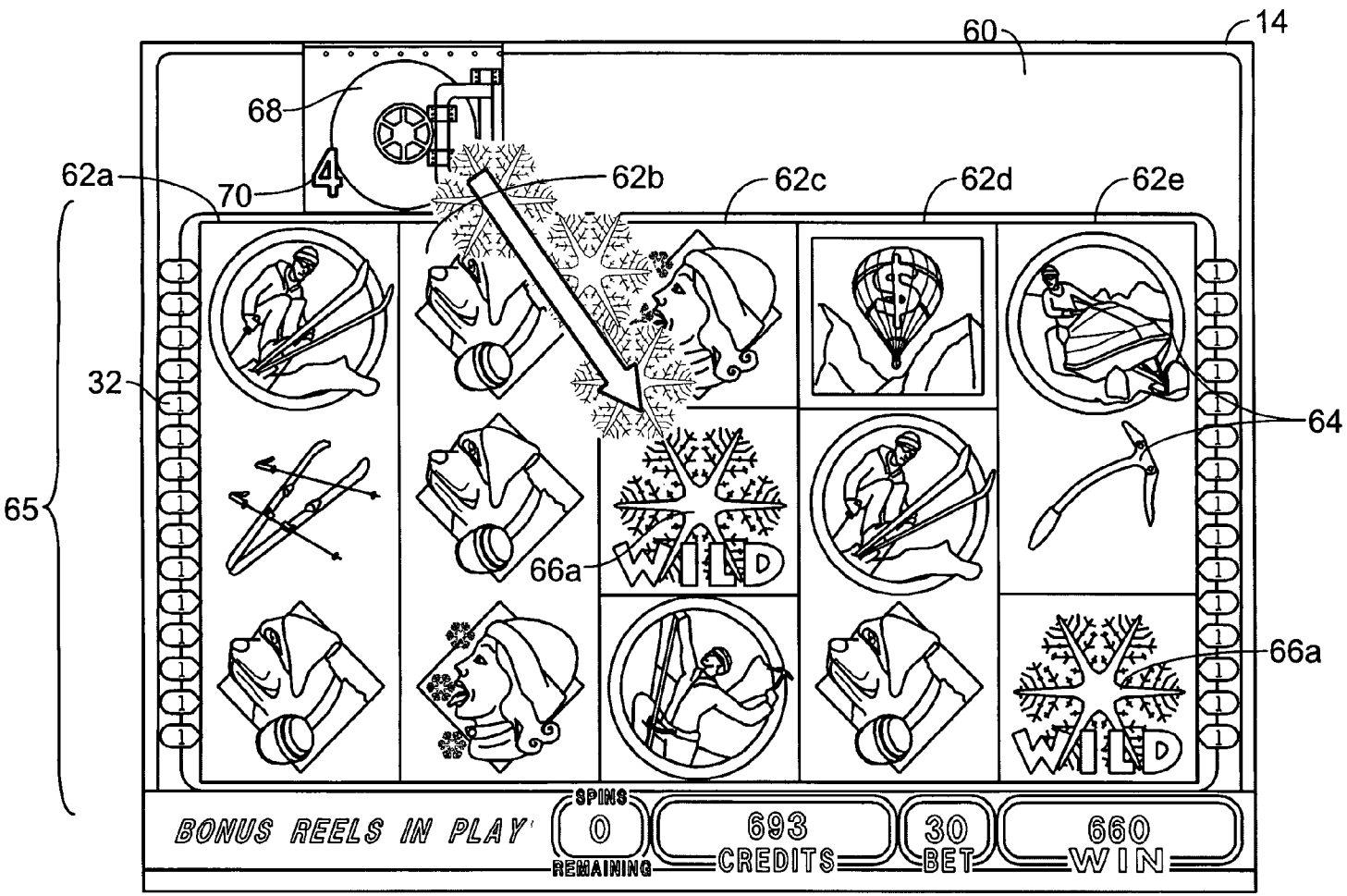
FIG. 7 is another view of the primary display, depicting the redemption of a first special symbol.

Following the Super Spin, the wild symbols 66*a* collected in the vault 68 are redeemed. As seen in FIG. 7, the wild symbols 66*a* leave the vault 68 and replace randomly selected standard symbols 64 on the reels 62. In this embodiment, the wild symbols 66*a* leave the vault 68 when being redeemed and are not permitted to replace other wild symbols 66*a* already on the reels 62. In other embodiments, other rule sets may be utilized to control which symbols 64 the redeemed special symbols 66*a* may or may not replace. As the first wild symbols 66*a* leaves the vault 68, as seen in FIG. 7, the collection meter 70 is decremented from five to four to indicate to the player that he or she has four remaining wild symbols 66*a* to be redeemed. The redemption may be depicted in a variety of ways, and may included entertaining graphics and sound as the redeemed wild symbol 66*a* travels from the vault 68 to its randomly selected position on the reels 62. The special symbols 66*a* may leave the vault 68 one at a time, in groups, or all at once.

Figure 8:
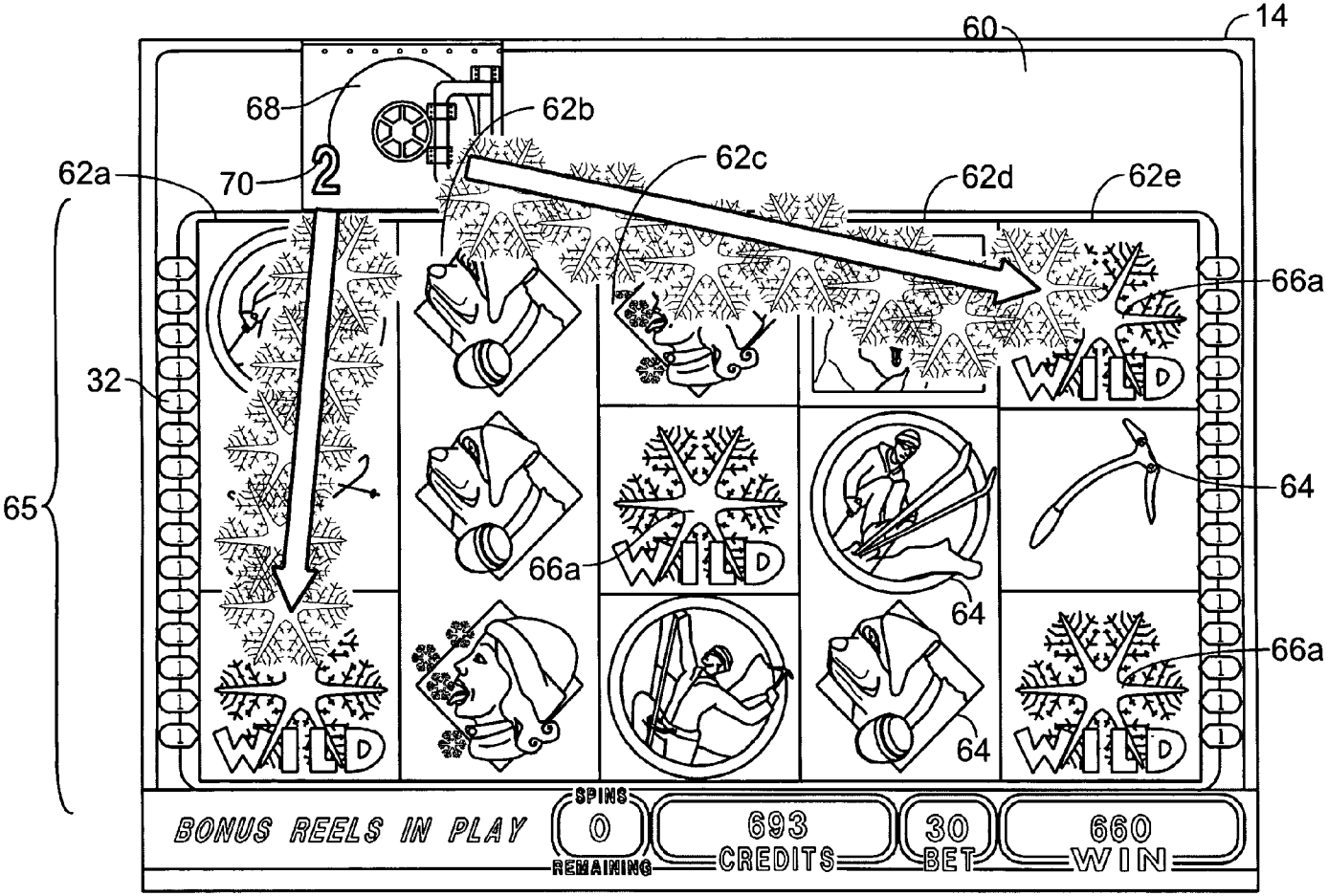
FIG. 8 is another view of the primary display, depicting the redemption of two additional special symbols.

In FIG. 8, two more wild symbols 66*a* are redeemed. In this case, the two redeemed wild symbols 66*a* exit the vault 68 simultaneously for added excitement and effect. Again the redeemed symbols 66*a* leave the vault 68 and are positioned on randomly selected locations on the reels 62 that are not already occupied by wild symbols 66*a*. The collection meter 70 is again decremented from four to two to indicate to the player that two collected wild symbols 66*a* remain in the vault 68 for redemption.

Figure 9:
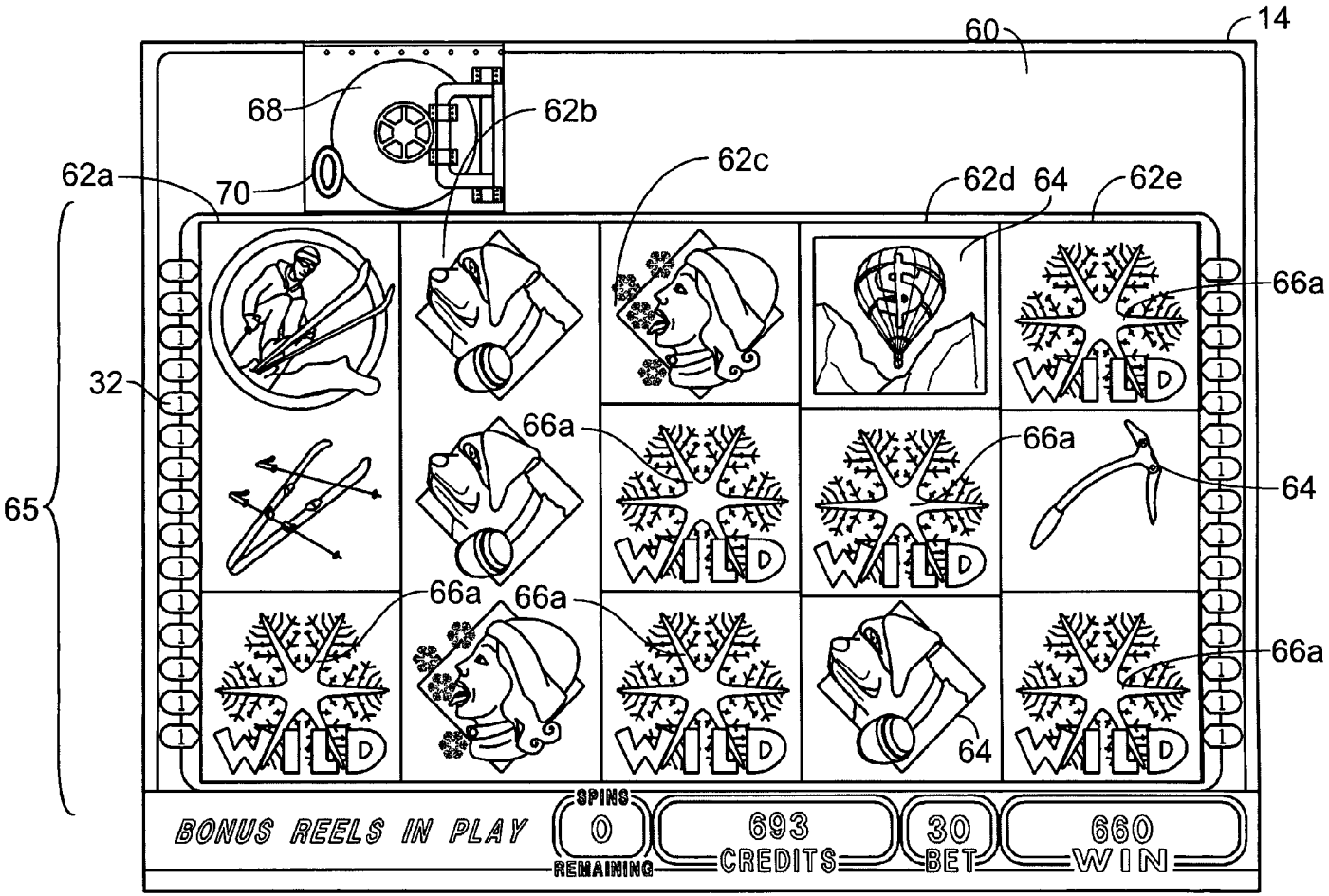
FIG. 9 is another view of the primary display, depicting the conclusion of the redemption of special symbols.

Turning to FIG. 9, the conclusion of the Snowflake Bonus is depicted. The vault 68 is emptied and all of the collected wild symbols 66*a* have been redeemed. Thus, the reels 62 now include six wild symbols (one which landed on the Super Spin, and five which were redeemed from the vault 68). The collection meter 70 reflects that the vault 68 is empty by indicating that zero wild symbols 66*a* remain to be redeemed. Now that redemption is complete, the symbols 64 on the reels 62 are evaluated for winning combinations on active paylines 32. Because of the relatively larger number of wild symbols 66*a*, the chances of achieving winning combinations is greatly increased. In this way, the collection and redemption of special symbols 66 increases player excitement as larger amounts of special symbols 66 are allowed to be simultaneously employed and evaluated.

In the embodiments shown in the FIGURES, the collected special symbol 66*a* is a wild symbol 66*a*. However, in alternate embodiments, many other types of special symbols 66 may be collected and redeemed. In addition to, or instead of the wild symbols 66*a*, the collected special symbols 66 could include bonus triggering symbols, bonus symbols, multiplying symbols, symbol upgrade symbols, progressive jackpot symbols, or any other symbol having improved or additional functionality. Moreover, more than one special symbol 66 could be collected simultaneously. For example, wild symbols could be collected in one vault while multiplier symbols were collected in another vault. During redemption, both types of collected special symbols could be redeemed.

In alternate embodiments, collection of special symbols 66 need not occur only during free spins, as shown in the FIGURES. For example, collection of special symbols 66 could occur during regular plays of the wagering game 60. Collection may require other criteria as well, such as only occurring on certain paylines 32, only occurring if certain betting criteria have been satisfied, etc. Similarly redemption need not occur on a Super Spin as shown and described herein. Redemption may occur in a multitude of different ways, including after a predetermined number of special symbols 66 have been collected, upon player selection, upon collection of a "redemption" symbol, or randomly executed. Moreover, redemption may be partial redemption on one play of the wagering game 60 of the special symbols 66 collected in the vault 68, as opposed to redemption of all of the collected symbols 66 on one play of the game as shown in the FIGURES. In addition, the redemption need not be accomplished by randomly distributing the collected special symbols 66 into the matrix 65. Rather, the redemption may occur by distributing the special symbols 66 into the matrix 65 according to a defined formula, pattern, or algorithm. Moreover, the player may be permitted to select where the redeemed symbols are placed in the matrix 65. Many alternative collection and redemption mechanisms may be employed.

The gaming system of the present invention offers a number of benefits to players of the wagering game 60. The collection of special symbols 66 provides players with greatly increased excitement and enjoyment as potential awards grow quite large. The player is excited by the collection meter 70 increasing in number as the collected symbols 66 in the vault 68 grow. Moreover, the redemption of the collected special symbols 66 provides great entertainment to the player as he or she can visually perceive the increased opportunity for larger awards as the redeemed symbols 66 are placed on the reels 62 for evaluation. The pooling of special symbols 66 generates great interest and popularity in the wagering game 60.

In alternative embodiments, special symbols may be collected, stored, and later redeemed to the same locations from which they were collected (or other predetermined locations). As depicted and described with relation to FIGS. 10-15, a "Time Machine" wagering game is yet another embodiment of a free spin game that incorporates collection and redemption of special symbols. The Time Machine free spin game is triggered in response to the occurrence of a triggering event. In one embodiment, the triggering event comprises the occurrence or appearance of one or more triggering symbols during a play of a base wagering game. In other embodiments, many other triggering events may be employed to trigger the start of the Time Machine free spin game. During the free spin game, a player is awarded a number of free spins and a final spin, referred to in the Time Machine game as a "future" spin. When the free spin bonus game begins, a secondary or second display 216 is used to collect and display special symbols 266 that may occur or appear during the free spin round. As described in more detail herein, the collected special symbols are later redeemed as part of the future spin.

Figure 10:
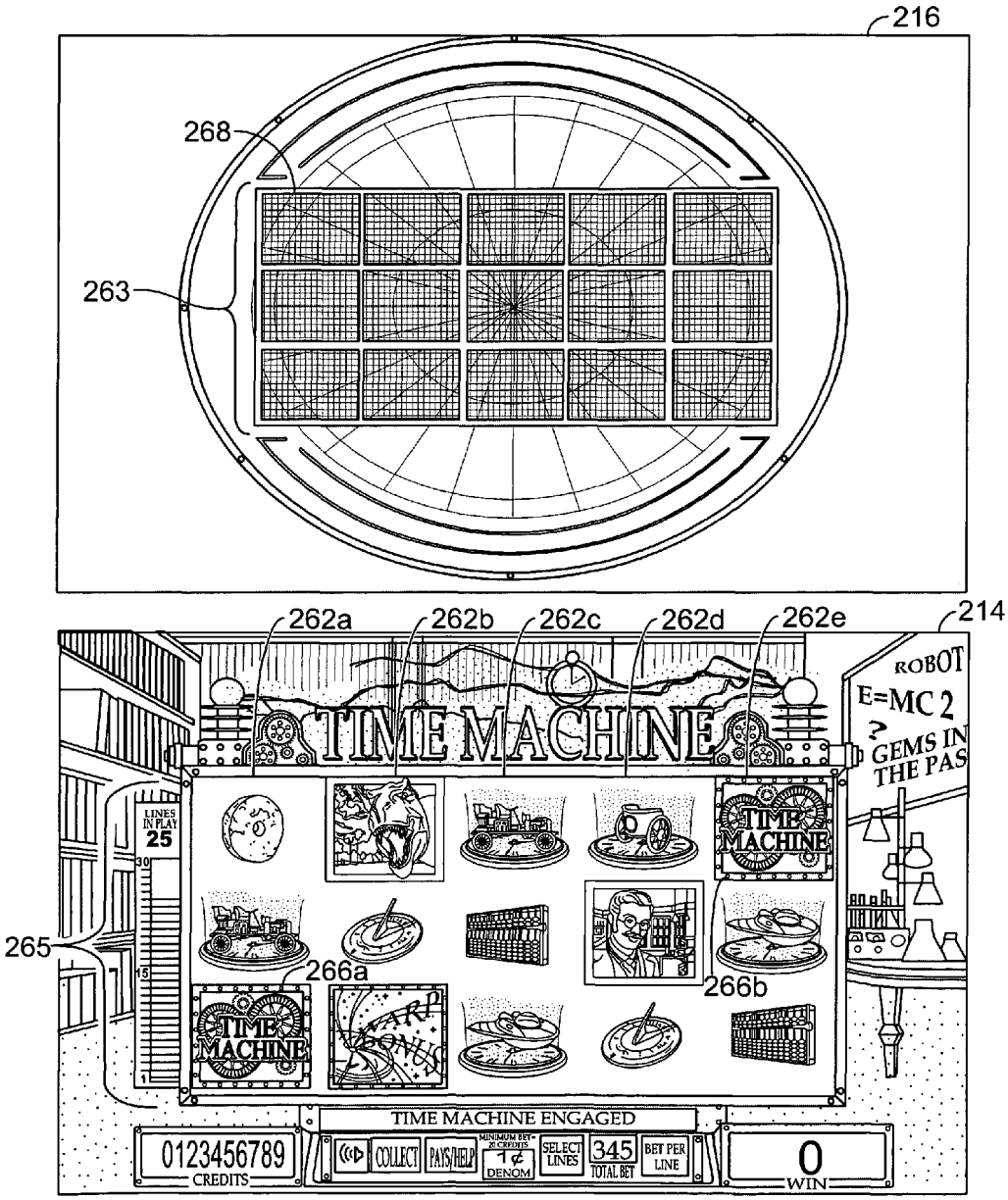
FIG. 10 is a view of first and second displays of a gaming system having special symbols collectible in a matrix.

Turning to FIG. 10, the result of a free spin that occurred during a Time Machine game is illustrated. The game comprises a first matrix 265 displayed on a first display 214 and a second matrix 263 displayed on the second display 216. The first matrix of symbols 265 is created through the spinning and stopping of the symbol bearing reels 262*a-e* to display randomly selected outcomes, comprising combinations of symbols. The symbols include at least one special symbol having some special functionality. In this embodiment, a "Time Machine" symbol 266 is a special symbol which acts as a wild symbol when redeemed and replaced into a matrix of symbols. As a wild symbol, the Time Machine symbol 266 substitutes for certain other symbols used in the wagering game so as to maximize opportunities for creating winning combinations of symbols in the matrix 265, or a winning outcome.

In some embodiments, the second display 216 may contain an empty grid or second matrix 263 comprised of a plurality of collection positions 268. The second matrix 263 serves as a collection area in which occurrences of special symbols 266 in the first matrix 265 are copied and stored for later redemption. Each collection position 268 may be used to collect special symbols 266 that are displayed in the first display 214 during the free spin round. In the embodiment depicted, the matrix 263 of the second display 216 has the same dimensions as the first matrix 265 of the first display 214. For example, the first matrix 265 is comprised of five columns or reels 262,*a, b,c,d,e* and three rows of symbols 266 to form a matrix 265 of five columns and three rows. Accordingly the second matrix 263 is comprised of five columns and three rows of collection positions. Thus, the second matrix 263 has the same number of collection positions 268 as the first matrix 265 has symbol positions.

In an embodiment, the underlying primary wagering game may be played solely on the primary or first display 214, or may be displayed on both displays 214,216. In an embodiment, when the Time Machine bonus game is triggered and commences, the second display 216 may appear above the first display 214, or may become activated to display a second matrix 263 for collecting special symbols as described herein. In yet other alternative embodiments, both matrices 263,265 may be displayed on a single display, such as either the primary display 214, the secondary display 216, or any other appropriate display.

At this point in the Time Machine game depicted in FIG. 10, the player is still executing his remaining free spins and has yet to execute his future spin. The current free spin has resulted in two Time Machine symbols 266*a,b* appearing on the first matrix 265 of symbols. As described herein, the special symbols 266*a,b* are thus eligible for collection in the second matrix 263 of the second display 216.

Figure 11:
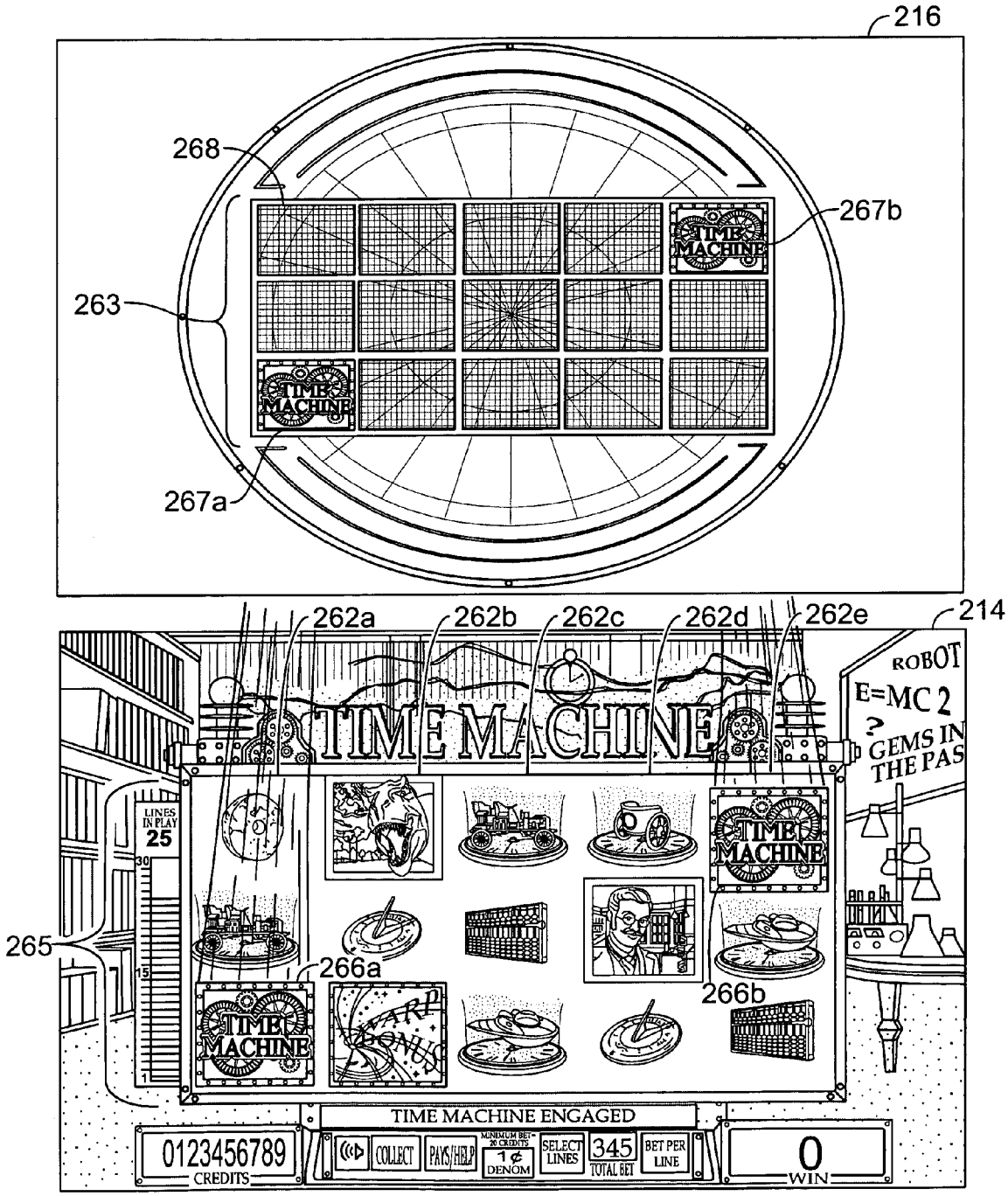
FIG. 11 is a view of the first and second displays depicting two collected special symbols.

FIG. 11 depicts the two special symbols 266*a,b* from the first matrix 265 in FIG. 10 being collected and displayed on the second matrix 263 for future redemption. Collection comprises copying the special symbols 266*a,b* from the first matrix 265 into the second matrix 263. In an embodiment, the special symbols 266*a,b* are copied into a position in the second matrix 263 which corresponds to a position from which they landed in the first matrix 265. In other words, the storage position of a special symbol 266 in the second matrix 263 corresponds to the landing position 268 of the special symbol 266 in the first matrix 265.

In an embodiment, the special symbols 266*a,b* are lifted off the reels 262 in an animated fashion so as to appear to fly or move toward a corresponding redemption position in the second matrix 263. In this embodiment, the corresponding redemption position is a collection position 268 in the second matrix 263 with the same coordinates as the special symbol 266 was displayed in the first matrix 265. Thus the special symbol 266*a* displayed in the first column of the third row of the first matrix 265 is copied and displayed in the first column of the third row of the second matrix 263. Similarly, the special symbol 266*b* displayed in the fifth column of the first row of the first matrix 265 is copied and displayed in fifth column of the first row of the second matrix 263. Thus in the second matrix 263 there is a collected special symbol 267*a* displayed in the third row of the first column and a collected special symbol 267*b* displayed in the fifth column of the first row.

Special symbols that appear in the first matrix 265 continue to be collected in the second matrix 263 as the player executes his free spins. Thus, collected symbols 267 from previous spins persist in the second matrix 263 while additional special symbols 266 are collected on subsequent spins. In some embodiments, once the player has executed all his free spins, the player is awarded a final or future spin. The number of free spins a player is allowed to execute may vary from embodiment to embodiment. The player may receive a predetermined number of free spins, or alternatively may continue to make free spins until a triggering event occurs (i.e., the player fails to achieve a winning outcome).

Figure 12:
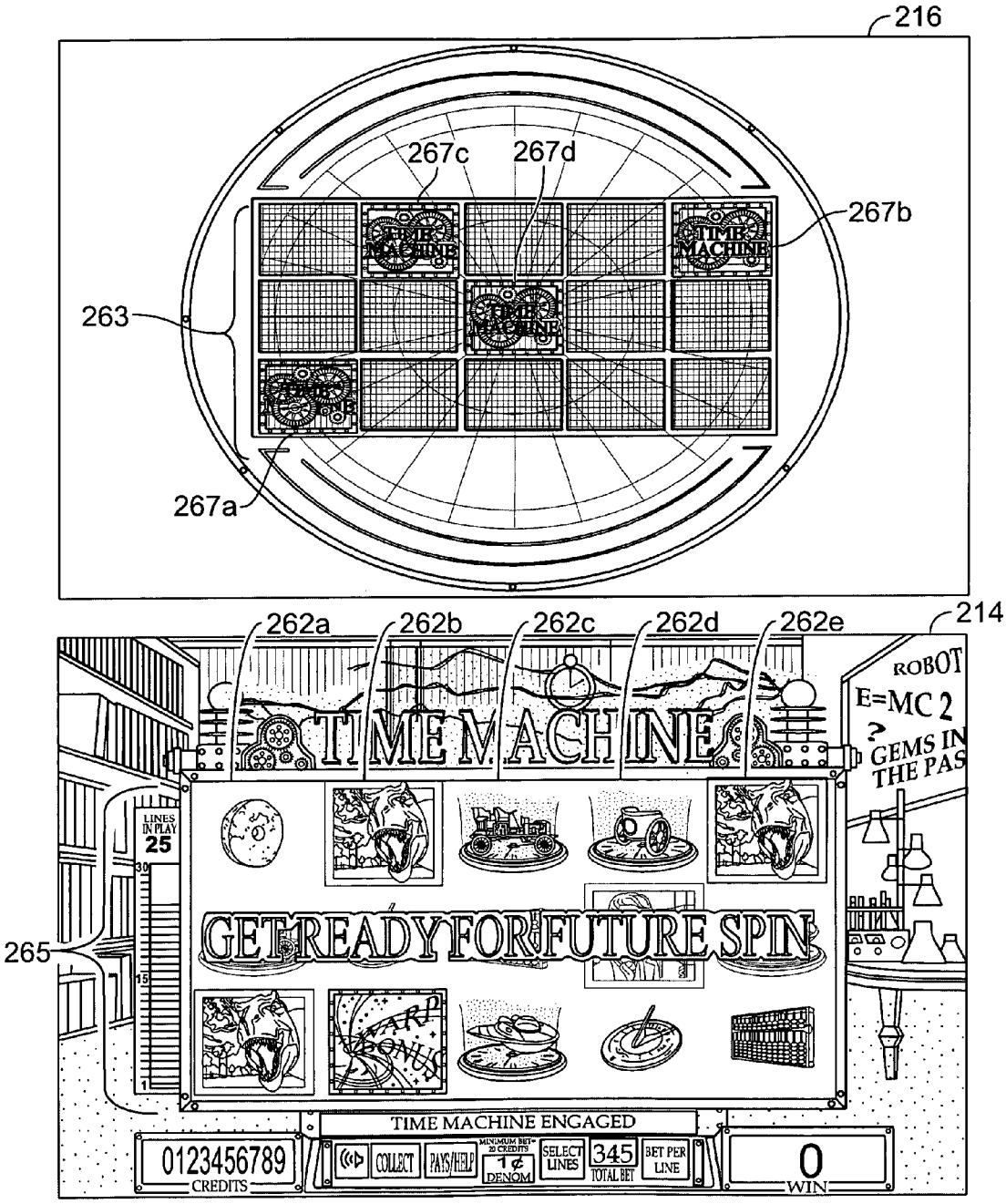
FIG. 12 is a view of the first and second displays depicting a final spin.

In FIG. 12, the player has executed all of his free spins and is about to execute the final or future spin. The availability of the future spin is communicated to the player through the message "GET READY FOR FUTURE SPIN" that is displayed on the first display 214. Displayed on the second matrix 263 are four special symbols 267*a,b,c,d* that were collected during the free spin round. In an embodiment, the future spin consists of one spin of the symbols in the first matrix 265, the result of which is displayed on the first display 214. The future spin may now be executed and the special symbols 267 redeemed as described herein.

Figure 13:
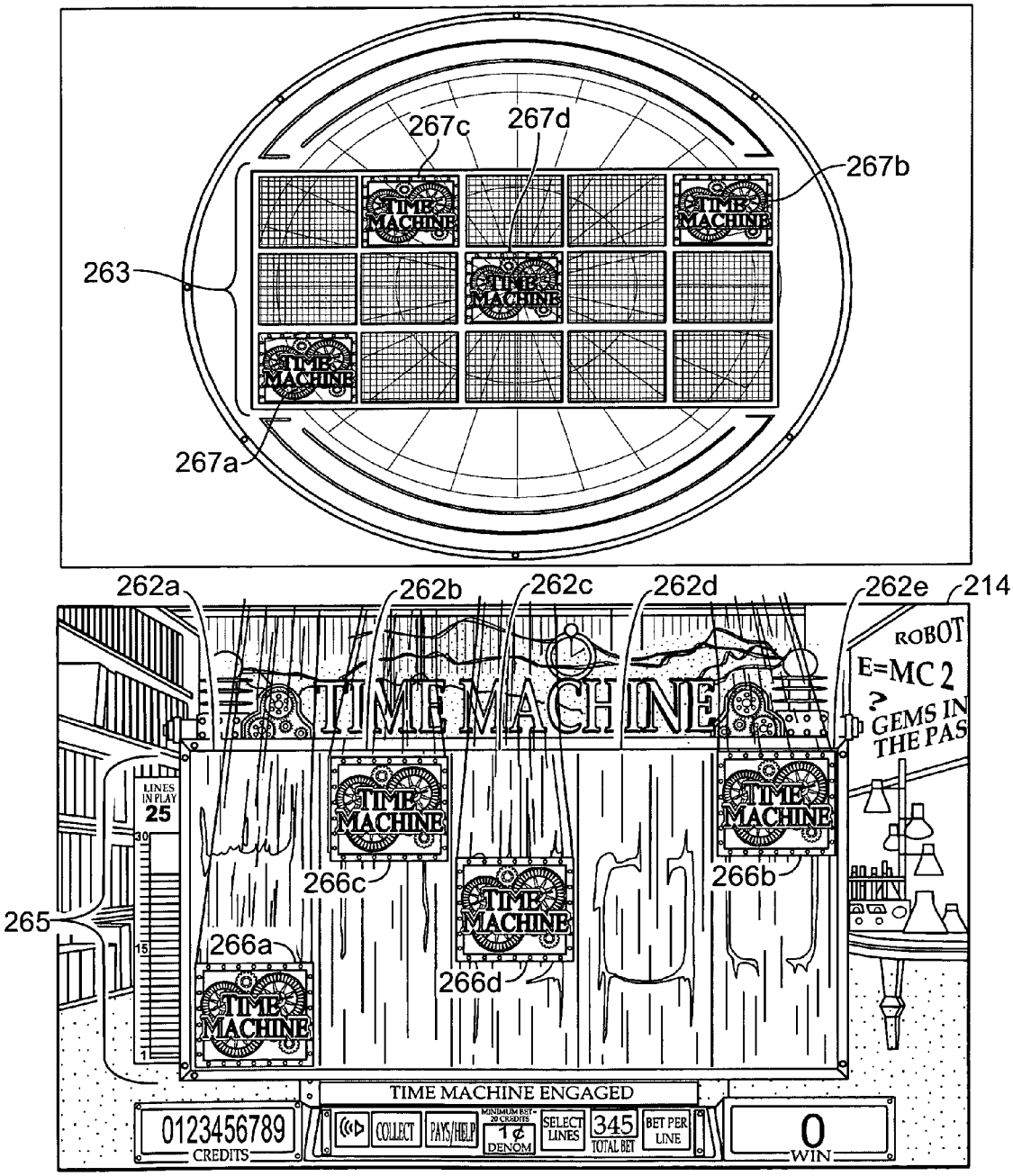
FIG. 13 is a view of the first and second displays depicting redemption of collected special symbols.

Turning to FIG. 13, depicted is the future spin that results in the redemption of the special symbols 267 displayed in the second matrix 263. The future spin has started and is in progress and the reels 262*a-e* are spinning, which is illustrated by the blurred symbols shown in the first matrix 265 of the first display 214 representing spinning reels 262. As the reels 262 spin, the special symbols 267 collected in the second matrix 263 are transported or re-copied down from the second matrix 263 to corresponding redemption positions in the first matrix 265. Accordingly the symbol 267*a* that is displayed in first column of the third row of the second matrix 263 is transported to its corresponding redemption position which is the first column of the third row of the first matrix 265. While the reels 262 are still spinning, each one of the remaining special symbols 267*b,c,d* of the second matrix 263 are similarly re-copied to their corresponding redemption positions in the first matrix 265. Thus the re-copied special symbols 266*a,b,c,d* are shown stationary, while the remaining symbols of the first matrix 265 are still in motion due to the spinning of the reels 262. Eventually the reels 262 of the first matrix 265 stop to reveal a random outcome of symbols of the wagering game as depicted in FIG. 14.

Figure 14:
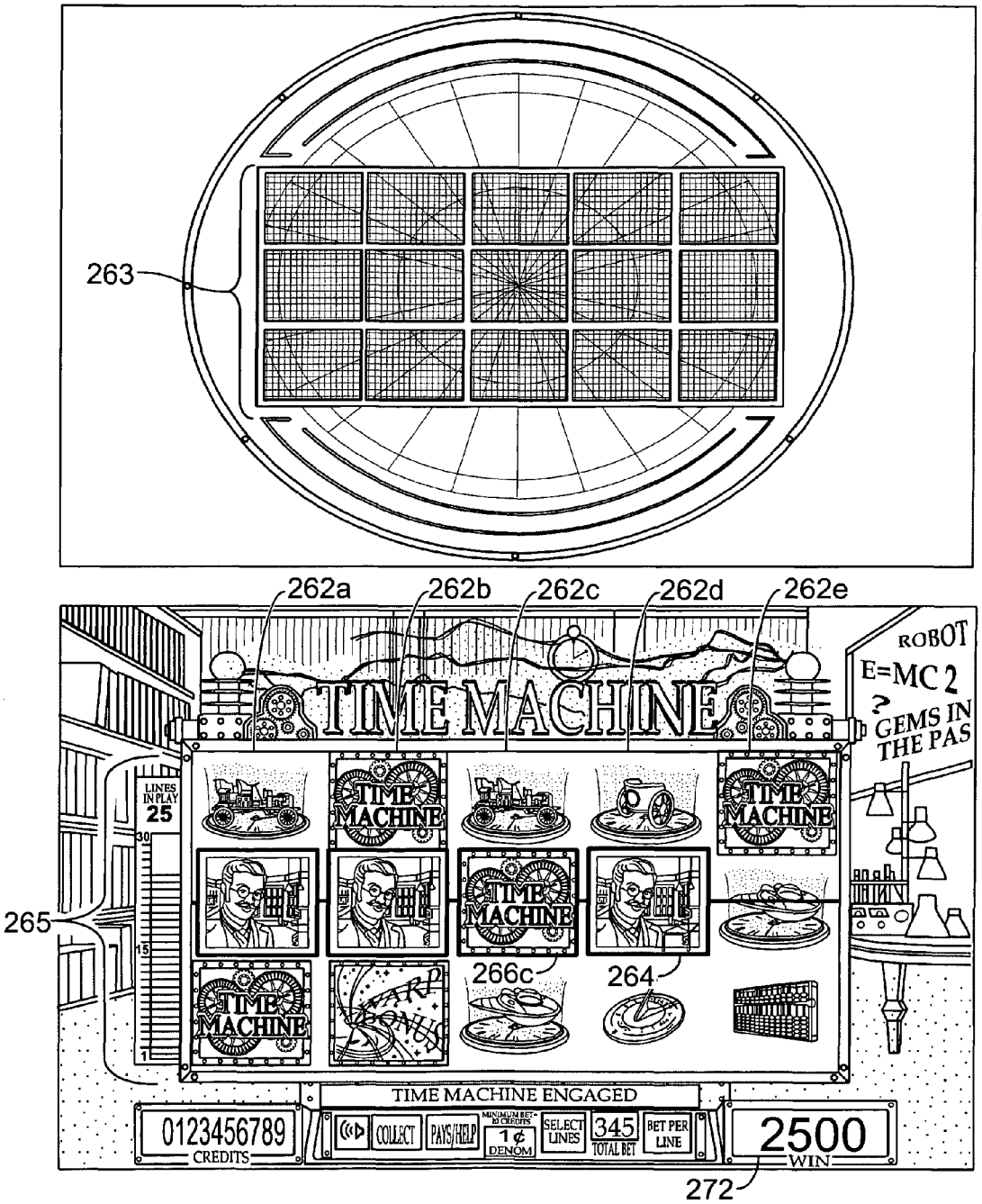
FIG. 14 is a view of the first and second displays depicting evaluation of a final matrix.

In FIG. 14, the future spin has completed and all the special symbols 267 have been redeemed, that is, re-copied from the second matrix 263 to their corresponding redemption position in the first matrix 265. Because all the special symbols have been recopied from the second matrix 263 to the first matrix 265, the second matrix 263 is now shown as empty to reinforce completion of the redemption process. With the special symbols 266 in their redemption positions and the reels of the first matrix 265 stopped to reveal a final matrix 265, the final matrix 265 is evaluated for winning outcomes. In the example depicted, three "Scientist" symbols 264 and a Time Machine symbol 266*c* have aligned on an activated payline (middle-row horizontal payline) which results in a two thousand five hundred credit award, which is displayed in the WIN meter 272. As described, the Time Machine symbol acts as a wild symbol and thus creates a four symbol win on this payline which would not otherwise have occurred without such wild symbol. Similarly, all other activated paylines are evaluated for winning combinations using the special Time Machine symbols as wild symbols.

In another embodiment, if more than one special symbol is collected in the same collection position of the second matrix 363, a multiplier is increased for each special symbol collected in the same collection position. Any accumulated multipliers are then applied when calculating a final award. For example, turning to FIG. 15, a two times multiplier ("2×") is displayed on top of a first collected special symbol 367*a* that is shown in a first collection position associated with the first column of the third row of the second matrix 363, and a three times multiplier ("3×") is displayed on top of a second collected special symbol 367*b* that is shown in a second collection position associated with the fifth column of the first row of the second matrix 363. The two times multiplier 367*a* indicates that two special symbols were collected in the first collection position while the player was executing his free spins. The three times multiplier 367*b* indicates that three special symbols were collected in the second collection position during the free spin round. As with the special symbols in FIG. 13, when redemption occurs on a final or future spin, the special symbols are recopied to the first matrix 265 along with their respective associated multipliers.

Figure 15:
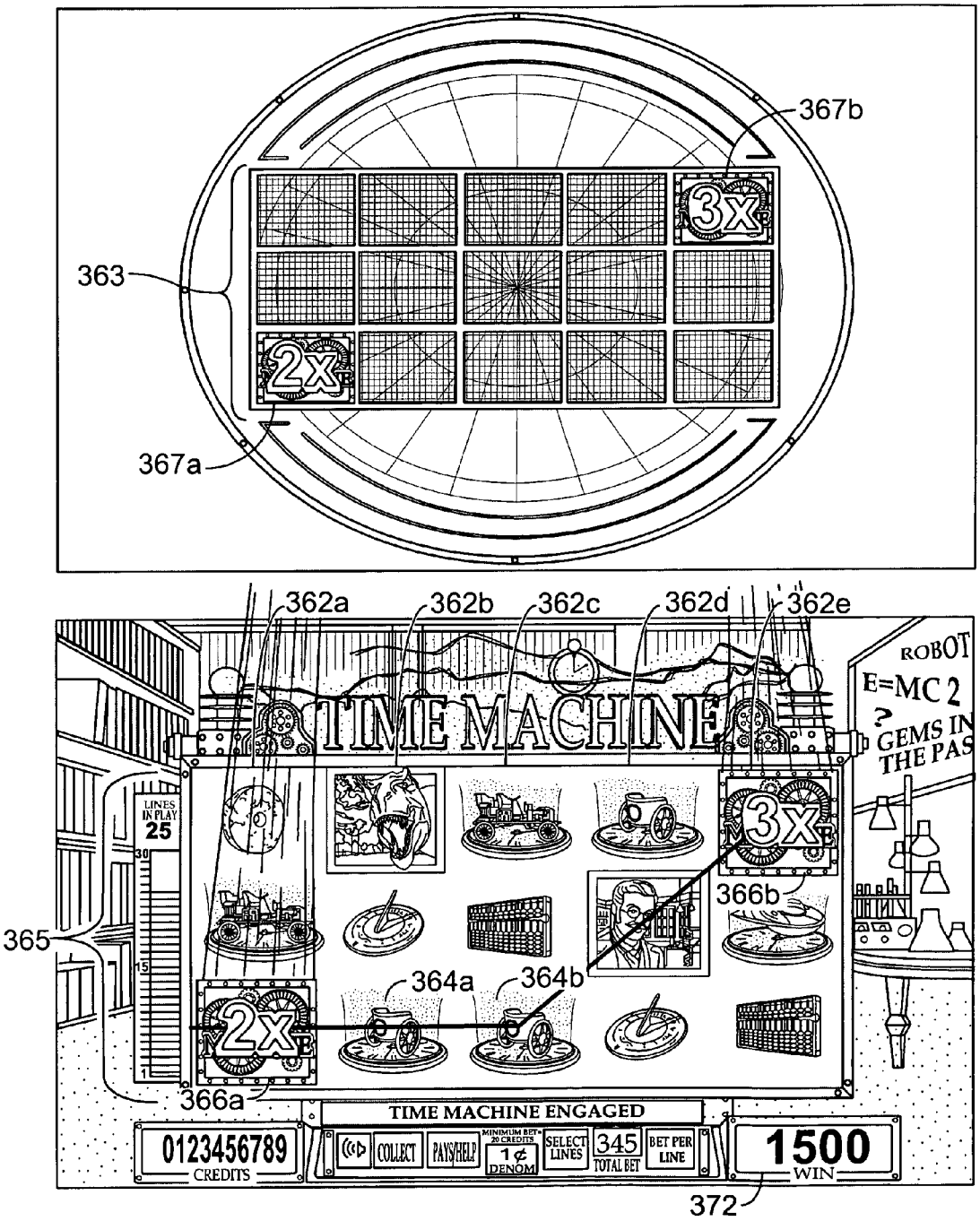
FIG. 15 is a view of the first and second displays depicting redemption and evaluation of collected special symbols with associated multipliers.

Thus, as see in FIG. 15, the Time Machine game has concluded and all free spins have been executed. The final or future spin has just been completed and the special symbols 366 have just been transported or re-copied and displayed in their corresponding redemption positions in the final matrix 365. Each special symbol has been redeemed or re-copied along with its associated multiplier. Thus, as before, the final matrix 365 is then evaluated for winning combinations. In this example, two special symbols 366*a,b* (acting as wild symbols) and two "Chariot" symbols 364*a,b* have aligned on an activated payline, which results in an award. In this example, a winning "four symbol combination" comprised of two Chariots and two special symbols normally results in a 250 credit award. In this instance however, the first collected special symbol 367*a* is additionally associated with a two times '2×' multiplier and the second special symbol 367*b* is additionally associated with a three times '3×' multiplier. The multipliers associated with each collected symbol 366 remain associated with the collected symbols as the collected symbols 366 are re-copied and redeemed to the first matrix 365. The multipliers are then applied to any resulting combinations of symbols, and thus are used when calculating an award. Thus to arrive at a final award for the "four symbol" combination, the 250 credit award is multiplied by the '2×' multiplier associated with the first redeemed special symbol 366*a*, and the product is then multiplied by the '3×' multiplier associated with the second redeemed symbol 366*b*. The result is thus six times larger, and the player receives a fifteen hundred credit award, which is displayed in the WIN meter 372. In other embodiments, the various multipliers may be applied in different ways. For example, a player may receive only the largest multiplier on any particular winning combination of symbols. Moreover, the multipliers may be added together and then applied to the winning award.

In some embodiments, it should be understood that on each free spin, the combination of symbols occurring in the first matrix 265 are evaluated for winning combinations. Thus, a player may be awarded credits for winning outcomes during the collection phase of the game (during the free spins) as well as during a final or future spin. In another embodiment, when a player executes a future spin, the final matrix 265 is evaluated a first time for winning combinations before any collected special symbols are redeemed. After awards associated with the first evaluation of the final matrix 265 are awarded, any special symbols that have been collected in the second matrix 263 are redeemed. Thus collected special symbols are re-copied from the second matrix 263 to their corresponding redemption positions in the final matrix 265. The final matrix 265 is then re-evaluated for winning combinations and any awards associated with winning combinations are awarded. In still another embodiment, only one display is used and the first and second matrixes 265, 263 are displayed on the one display.

It should be further understood that in some alternative embodiments, visual copying of collected special symbols may be omitted. That is, the second matrix 263 is optional. In some embodiments, special symbols 266 may be collected and stored virtually in memory, along with information relating to the collection position from which they were collected. Similarly, upon redemption, special symbols 266 being redeemed may be returned or re-copied to their respective redemption positions based upon the stored information relating to their collection position. Thus, the intermediate steps of copying the special symbols to a second matrix, or other storage area, and then re-copying them from such second matrix or other storage area back to the first matrix, are optional in an embodiment.

The present invention offers a number of benefits to players of wagering games. A player playing the Time Machine game is excited seeing special symbols 266 being collected in a second matrix 263 and the position in which the special symbols are collected may increase that excitement. For example, if a player collects more than one special symbol 266 in one row, the player's anticipation for a large future spin may be further piqued. The redemption of the collected special symbols 267 may bring further entertainment as the player sets the reels 262 in motion with his future spin, the player's anticipation for the final result is intensified knowing how many special symbols 266 were collected and where on the reels 262 the special symbols 266 will land. The collection of special symbols 266 on the second display 216 may also generate great interest in the Time Machine game as other players nearby notice the special symbols 266 displayed on the second display 216.

Each of these embodiments and obvious variations thereof is contemplated as falling within the spirit and scope of the claimed invention, which is set forth in the following claims.

What is claimed is:

1. A gaming system configured to conduct a base wagering game and a bonus game comprising:

a wager input device configured to receive a wager to conduct the base wagering game;

a display configured to display the base wagering game and the bonus game; and a controller operative to cause the display of a plurality of symbols in the base wagering game to represent a randomly selected outcome of the base wagering game, the symbols being displayed in a first matrix and being selected from a plurality of symbols including at least one special symbol, wherein the controller is further operative to, following an occurrence of a triggering condition and entry into the bonus game, conduct a plurality of free spins, each free spin generating a new matrix of symbols, and wherein the controller is further operative to (i) collect occurrences of the at least one special symbol in each of the free spins until such time as all of the plurality of free spins have occurred, (ii) create a final matrix of symbols following a display of a last matrix of symbols associated with a last free spin, (iii) redeem the collected special symbols by placing the collected special symbols into the final matrix, and (iv) provide an award if the final matrix of symbols indicates a winning combination.

2. The gaming system of claim 1, wherein the at least one special symbol is a wild symbol.

3. The gaming system of claim 1, wherein the collected special symbols are collected in a bank displayed on the display.

4. The gaming system of claim 3, wherein the bank includes a collection meter indicating the quantity of special symbols collected.

5. The gaming system of claim 1, wherein each redeemed special symbol is placed into a redemption position in the final matrix which corresponds to a collection position from which it was collected in a respective new matrix resulting from one of the free spins.

6. A method of conducting a wagering game on a gaming system, the method comprising:

receiving a wager via a wager input device;

conducting a wagering game by displaying, on a display device of the wagering game, a randomly selected outcome of the wagering game;

conducting a bonus game on the gaming system responsive to a triggering event associated with the randomly selected outcome of the wagering game;

sequentially displaying, on a display device of the gaming system, a plurality of matrices of symbols representing randomly selected outcomes of the bonus game, the symbols in the bonus game being selected from a plurality of standard symbols and at least one special symbol;

collecting occurrences of the at least one special symbol in the sequence of matrices displayed on the display in association with the bonus game until such time as all of the matrices in the sequence of matrices have been displayed;

displaying a final matrix of symbols following the sequential display of the plurality of matrices;

redeeming at least a portion of the collected special symbols by replacing a corresponding number of standard symbols in the final matrix with the portion of collected special symbols; and providing an award if the final matrix of symbols indicates a winning combination.

7. The method of claim 6, wherein the plurality of matrices comprises a predetermined number of matrices comprising a set of free games.

8. The method of claim 6, further comprising redeeming a remainder of the collected special symbols on a play of the wagering game occurring after the final matrix.

9. The method of claim 6, wherein the at least one special symbol is a wild symbol.

10. The method of claim 6, wherein the portion of the collected special symbols redeemed in the act of redeeming comprises all of the collected special symbols.

11. The method of claim 6, further comprising displaying the quantity of collected special symbols on a collection meter displayed on the display device.

12. The method of claim 6, wherein the collecting step includes moving collected special symbols into a bank.

13. The method of claim 6, wherein each redeemed special symbol is placed into a redemption position in the final matrix which corresponds to a collection position from which it was collected in a respective one of the plurality of matrices of symbols.

14. A non-transitory computer readable storage medium encoded with instructions configured to cause a controller controlling a gaming system to execute acts comprising:

receiving a wager via a wager input device;

conducting a wagering game by displaying, on a display device of the wagering game, a randomly selected outcome of the wagering game;

conducting a bonus game on the gaming system responsive to a triggering event associated with the randomly selected outcome of the wagering game;

sequentially displaying, on a display device of the gaming system, a plurality of matrices of symbols representing randomly selected outcomes of the bonus game, the symbols in the bonus game being selected from a plurality of standard symbols and at least one special symbol;

collecting occurrences of the at least one special symbol in the sequence of matrices displayed on the display in association with the bonus game until such time as all of the matrices in the sequence of matrices have been displayed;

displaying a final matrix of symbols following the sequential display of the plurality of matrices;

redeeming at least a portion of the collected special symbols by replacing a corresponding number of standard symbols in the final matrix with the portion of collected special symbols; and providing an award if the final matrix of symbols indicates a winning combination.

15. A method of conducting a wagering game on a gaming system, the method comprising:

receiving a wager via a wager input device;

determining a randomly determined outcome of the base wagering game using a controller;

displaying the randomly determined outcome of the base wagering game on a display device of the gaming system;

triggering a bonus game responsive to a triggering event associated with the base wagering game;

awarding a number of free plays in a first stage of the bonus game;

for each free play of the bonus game in the first stage of the bonus game, (i) displaying a matrix of symbols representing a randomly selected outcome of the bonus game, the symbols selected from a plurality of symbols including at least one special symbol; and (ii) collecting any occurrences of the at least one special symbol in the matrix;

after all of the free plays in the number of free plays are complete, displaying a subsequent matrix of symbols in a second stage of the bonus game;

redeeming the special symbols collected in the first stage of the bonus game by replacing a first group of symbols in the subsequent matrix of the second stage of the bonus game with the collected special symbols; and providing an award if the subsequent matrix of symbols indicates a winning combination.

16. The method of claim 15, wherein the at least one special symbol is a wild symbol.

17. The method of claim 15, wherein the number of free plays awarded is a predetermined number.

18. The method of claim 15, further comprising displaying a collection meter indicating the balance of special symbols collected.

19. The method of claim 15, wherein the first group is randomly selected.

20. The method of claim 15, wherein the special symbols collected in the first stage of the bonus game are displayed in a second matrix.

21. The method of claim 20, wherein the second matrix is displayed on a secondary display device.

22. The method of claim 15, wherein each redeemed special symbol is placed into a redemption position in the subsequent matrix in the second stage of the bonus game which corresponds to a collection position from which it was collected in a respective one of the matrices displayed in the first stage of the bonus game.

23. A gaming system configured to conduct a base wagering game and a bonus game comprising:

a wager input device configured to receive a wager to conduct the base wagering game;

a first display configured to display the base wagering game and the bonus game; and a controller operative to cause the display of a first matrix of symbols in the base wagering game, the first matrix of symbols representing a randomly selected outcome of the wagering game, the symbols being disposed to populate the first matrix of symbols being selected from a plurality of symbols including at least one special symbol, wherein the controller is further operative to, following an occurrence of a triggering condition and entry into the bonus game, conduct a plurality of free plays in a first stage of the bonus game, each free play generating a new matrix of symbols, and wherein the controller is further operative to (i) copy each occurrence of the at least one special symbol in a matrix of symbols occurring in the first stage of the bonus game into to a corresponding collection position in a second matrix displayed on the first display or on a second display until the last of the free plays in the first stage of the bonus game has occurred, (ii) create a final matrix of symbols in a second stage of the bonus game following the occurrence of the last of the free plays in the first stage of the bonus game, (iii) redeem the collected special symbols by re-copying each such collected special symbol from the second matrix to a corresponding redemption position in the final matrix, and (iv) provide an award if the final matrix of symbols indicates a winning combination.

24. The gaming system of claim 23, wherein a layout of the second matrix is equivalent to a layout of the first matrix.

25. The gaming system of claim 24, wherein the first and second matrix comprise the same number of rows and the same number of columns.

26. The gaming system of claim 23, wherein a multiplier is applied to a special symbol collected in the second matrix if more than one special symbol is collected in the same collection position.

27. The gaming system of claim 26, wherein the award is modified by the multiplier.

28. The gaming system of claim 26, wherein the multiplier is increased for each subsequent special symbol collected in the same collection position.

29. The gaming system of claim 23, wherein the controller is further operative to provide a second award if the first matrix of symbols indicates a winning combination.

30. The gaming system of claim 23, wherein the second matrix is displayed on the first display.

* * * * *